US007422460B2

(12) United States Patent
Cheng et al.

(10) Patent No.: US 7,422,460 B2
(45) Date of Patent: Sep. 9, 2008

(54) ADJUSTABLE CONNECTION MECHANISM FOR USE IN UNINTERRUPTIBLE POWER SUPPLY APPARATUS

(75) Inventors: Ching-Wen Cheng, Taoyuan Hsien (TW); Shih-Feng Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 339 days.

(21) Appl. No.: 11/299,127

(22) Filed: Dec. 9, 2005

(65) Prior Publication Data

US 2007/0087622 A1 Apr. 19, 2007

(30) Foreign Application Priority Data

Oct. 18, 2005 (CN) ..... 2005 1 0114077

(51) Int. Cl.
*H01R 13/62* (2006.01)

(52) U.S. Cl. ..... 439/310; 439/259; 439/297; 439/374; 439/910; 439/928.1

(58) Field of Classification Search ..... 439/910, 439/310, 259, 297, 374, 928.1
See application file for complete search history.

(56) References Cited

U.S. PATENT DOCUMENTS 3,111,355 A * 11/1963 Samburoff et al. ..... 439/159
5,461,546 A * 10/1995 Kobayashi et al. ..... 361/796
7,301,356 B2 * 11/2007 Machado ..... 324/755

* cited by examiner

*Primary Examiner*—Tho D Ta

(57) ABSTRACT

An adjustable connection mechanism of an uninterruptible power supply apparatus includes a first connector, a second connector, a supporting member and a carrier plate. The first connector is arranged on a battery module and electrically connected to the battery module. The second connector is electrically connected to a power supply module and a control module of the uninterruptible power supply apparatus. The supporting member is disposed within a case for supporting the second connector. The carrier plate is coupled with the second connector, and selectively movable to a first position to have the second connector disconnect with the first connector or movable to a second position to have the second connector connect with the first connector.

11 Claims, 9 Drawing Sheets

ADJUSTABLE CONNECTION MECHANISM FOR USE IN UNINTERRUPTIBLE POWER SUPPLY APPARATUS

FIELD OF THE INVENTION

The present invention relates to an adjustable connection mechanism, and more particularly to an adjustable connection mechanism for use in an uninterruptible power supply apparatus.

BACKGROUND OF THE INVENTION

Uninterruptible power supply (UPS) apparatuses are widely used to provide stable power to electronic and communication systems. If the voltage of the commercial AC power is subject to a sudden variation or interruption, the power to the electronic and communication systems could be maintained at an applicable level by using the UPS apparatus.

Referring to FIG. 1, a schematic exploded view of a conventional UPS apparatus is illustrated. The UPS apparatus 1 comprises a case 10, a power supply module 11, a battery module 12, a control module 13, a first cover plate 14 and a second cover plate 15. The inner space within the case 10 is partitioned into several compartments by a first partition plate 101 and a second partition plate 102, wherein the first partition plate 101 is perpendicular to the second partition plate 102. Under this circumstance, the power supply module 11, the battery module 12 and the control module 13 may be accommodated within the compartments.

The battery module 12 comprises a positive terminal 121, a negative terminal 122 and a first connector 16. The positive terminal 121 and the negative terminal 122 are electrically connected to the first connector 16 via power wires 17. The front end of the first connector 16 has conducting terminals (not shown) to be coupled with the conducting terminals of a second connector 18. In addition, the second connector 18 is electrically connected to the control module 13 and the power supply module 11. Once the first connector 16 is coupled with the second connector 18, the battery module 12 will make electric connection with the control module 13 and the power supply module 11.

The first cover plate 14 and the second cover plate 15 serve as the upper cover plate and the front panel, respectively. After the power supply module 11, the battery module 12 and the control module 13 are mounted within the case 10, the first cover plate 14 and the second cover plate 15 are coupled to the case 10 via certain fastening means so as to fabricate the UPS apparatus 1.

According to the safety regulations provided by some countries, during transportation of the UPS apparatus 1, the battery module 12 should be disconnected with the control module 13 and/or the power supply module 11. That is to say, before transportation, communication or conduction between the conducting terminals of the first connector 16 and the conducting terminals of the second connector 18 are interrupted. For example, the second cover plate 15 is firstly detached from the case 10, and then the battery module 12 is pushed out of the case 10. After the first connector 16 is disconnected with the second connector 18, the battery module 12 is pushed backward to its original location and the second cover plate 15 is coupled to the case 10. Alternatively, the first cover plate 14 is detached from the case 10, the first connector 16 is disconnected with the second connector 18, and finally the first cover plate 14 is coupled to the case 10. When the UPS apparatus 1 is ready for operation, the first cover plate 14 or the second cover plate 15 should be detached, the first connector 16 is coupled with the second connector 18, and finally the first cover plate 14 or the second cover plate 15 is coupled to the case 10.

In addition to transportation of the UPS apparatus 1, the battery module 12 should be disconnected with the control module 13 and/or the power supply module 11 if the UPS apparatus 1 has not been used for a long term. In other words, the users should repeat dismantling and assembling operations during transportation or for a long unused term. As known, the dismantling and assembling operations are time-consuming and labor-intensive. In addition, if the first connector 16 is disconnected with the second connector 18, the UPS apparatus 1 is possibly thought to have a breakdown by erroneous judgment.

Alternatively, the first connector 16 and the second connector 18 may be replaced with electronic switch devices. The electronic switch devices, however, are large in volume and high in cost and have high power consumption.

In views of the above-described disadvantages resulted from the conventional method, the applicant keeps on carving unflaggingly to develop an adjustable connection mechanism for use in an uninterruptible power supply apparatus according to the present invention through wholehearted experience and research.

SUMMARY OF THE INVENTION

It is an object of the present invention to provide an adjustable connection mechanism for use in an uninterruptible power supply apparatus in order that the connection status between the battery module and other modules of the UPS apparatus is adjusted in a connection mode or a disconnection mode without repeating dismantling and assembling operations.

It is another object of the present invention to provide an adjustable connection mechanism for use in an uninterruptible power supply apparatus without the need of using electronic switch devices.

In accordance with a first aspect of the present invention, there is provided an adjustable connection mechanism of an uninterruptible power supply apparatus. The uninterruptible power supply apparatus includes a case accommodating therein a power supply module, a battery module and a control module. The adjustable connection mechanism includes a first connector, a second connector, a supporting member and a carrier plate. The first connector is arranged on the battery module and electrically connected to the battery module. The second connector is electrically connected to the power supply module and the control module. The supporting member is disposed within the case for supporting the second connector. The carrier plate is coupled with the second connector, and selectively movable to a first position to have the second connector disconnect with the first connector or movable to a second position to have the second connector connect with the first connector.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
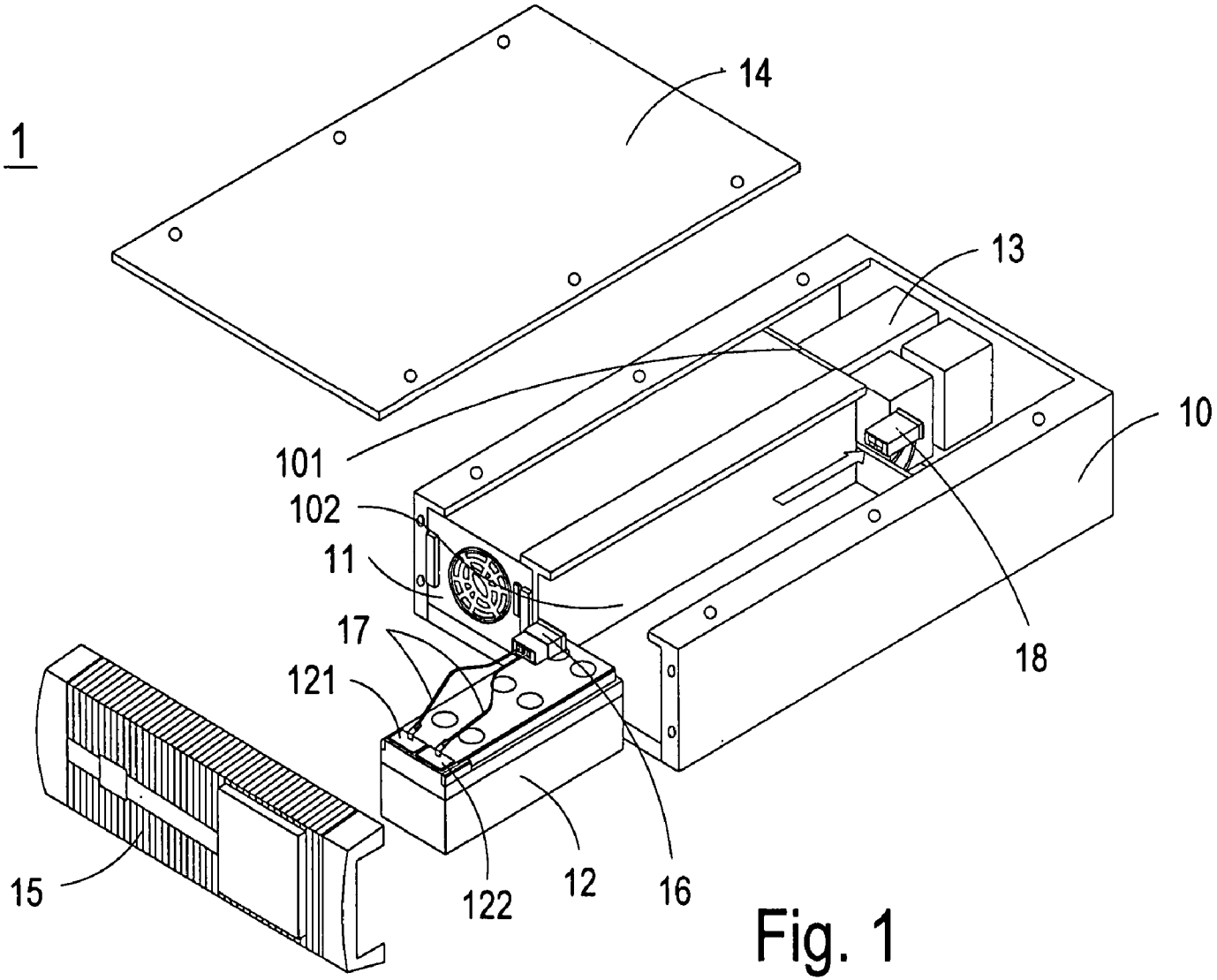
Fig. 1 PRIOR ART
FIG. 1 is a schematic exploded view of a conventional UPS apparatus.
Figure 2:
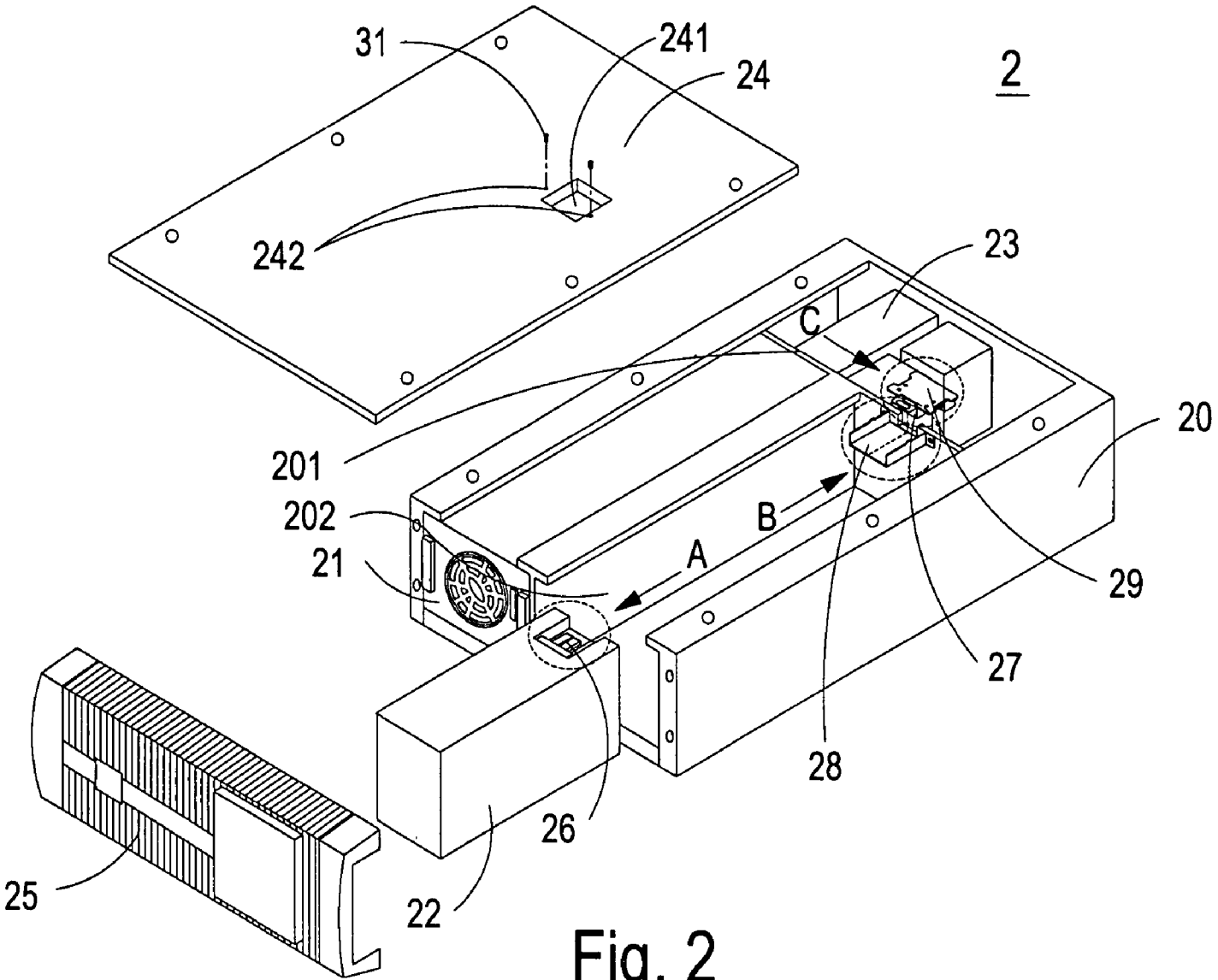
FIG. 2 is a schematic exploded view of a UPS apparatus having an adjustable connection mechanism according to a preferred embodiment of the present invention.

Referring to FIG. 2, a schematic exploded view of a UPS apparatus having an adjustable connection mechanism according to a preferred embodiment of the present invention is illustrated. The UPS apparatus 2 comprises a case 20, a power supply module 21, a battery module 22, a control module 23, a first cover plate 24, a second cover plate 25 and an adjustable connection mechanism. The inner space within the case 20 is partitioned into several compartments by a first partition plate 201 and a second partition plate 202, wherein the first partition plate 201 is perpendicular to the second partition plate 202. Under this circumstance, the power supply module 21, the battery module 22 and the control module 23 may be accommodated within the compartments. The first cover plate 24 and the second cover plate 25 serve as the upper cover plate and the front panel, respectively. The adjustable connection mechanism comprises a first connector 26, a second connector 27, a supporting member 28 and a carrier plate 29. By means of the adjustable connection mechanism, the battery module 22 is switched to connect or disconnect with other modules of the UPS apparatus 2.

Figure 3:
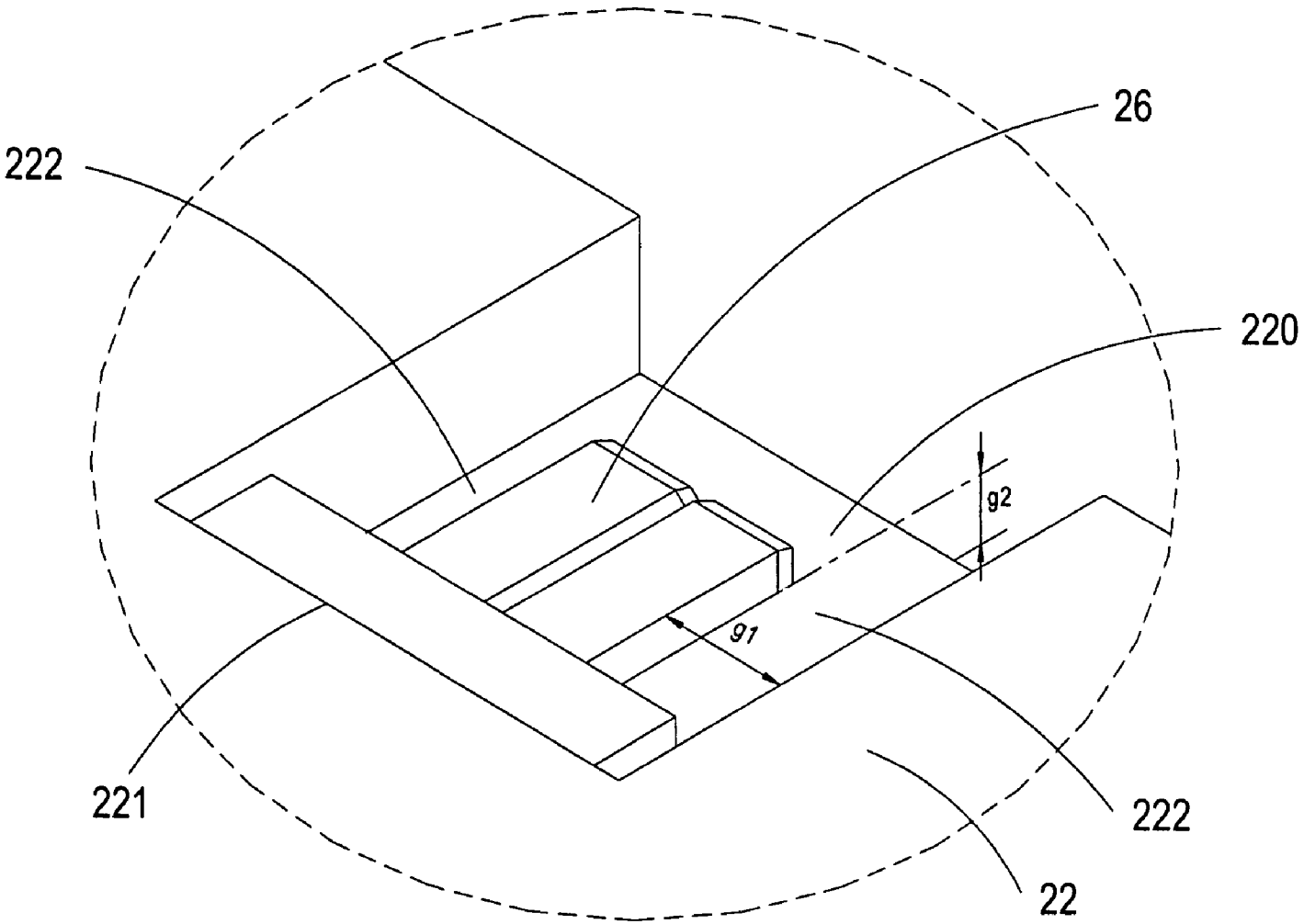
FIG. 3 is an enlarged partial view of the area A of the UPS apparatus shown in FIG. 2.

Please refer to FIG. 3, which is an enlarged partial view of the area A of the UPS apparatus 2 shown in FIG. 2. The battery module 22 has an indentation structure 220 at a top edge thereof. The first connector 26 is protruded from an inner wall 221 of the indentation structure 220. The first connector 26 is electrically connected to the positive terminal and the negative terminal (not shown) within the battery module 22 and coupled with corresponding conducting terminals of the second connector 27. In addition, a first gap g1 is formed between either lateral side of the first connector 26 and the corresponding lateral wall of the indentation structure 220, and a second gap g2 is formed between the bottom surface of the first connector 26 and the bottom surface of the indentation structure 220.

Figure 4:
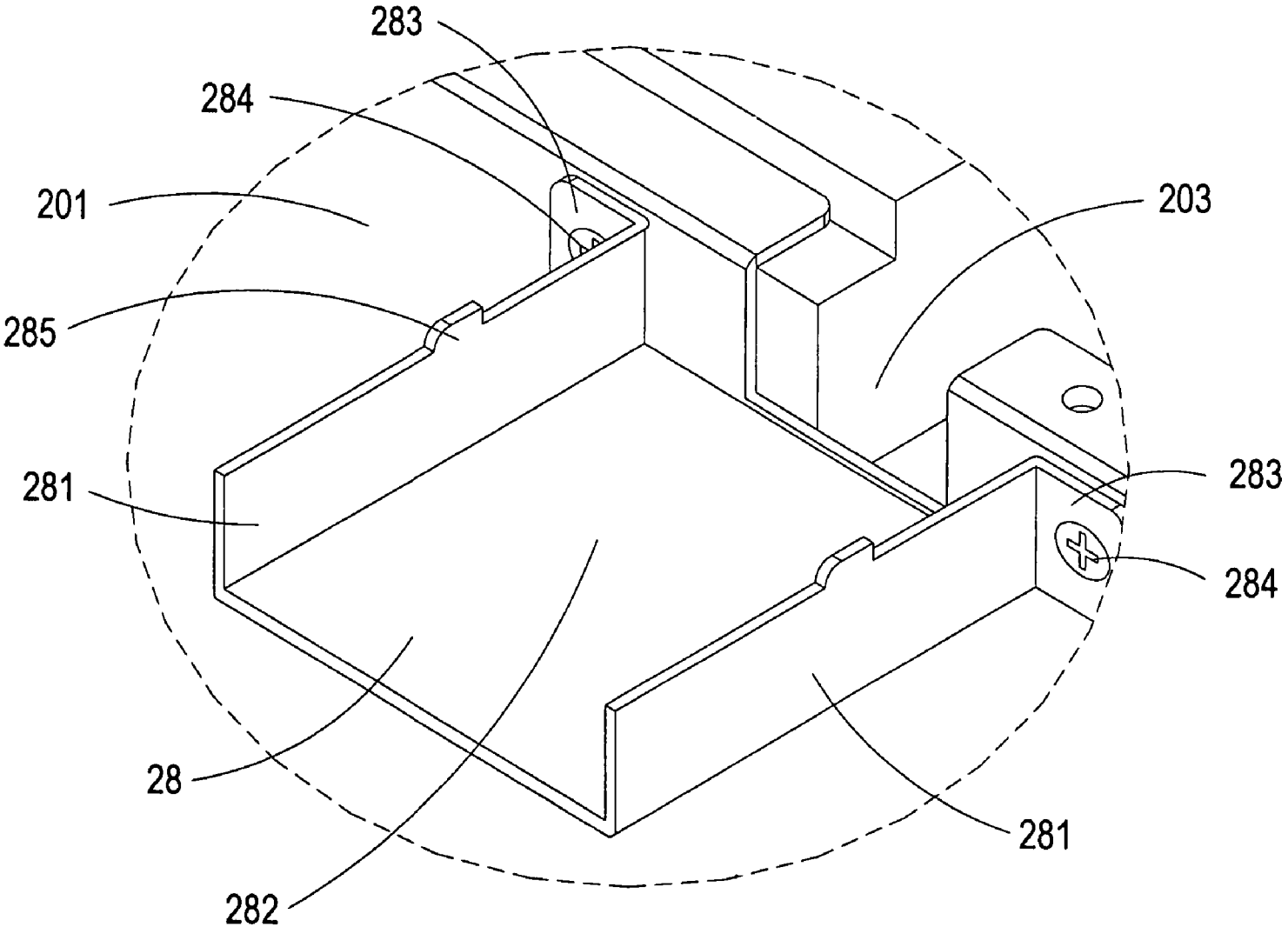
FIG. 4 is an enlarged partial view of the area B of the UPS apparatus shown in FIG. 2.

Please refer to FIG. 4, which is an enlarged partial view of the area B of the UPS apparatus 2 shown in FIG. 2. The first partition plate 201 has a notch 203. The supporting member 28 is disposed in the vicinity of the notch 203 and perpendicular to the first partition plate 201, and faces to the indentation structure 220 of the battery module 22. The supporting member 28 is substantially a U-shaped metallic plate. The bilateral sides 281 and the bottom side of the U-shaped metallic plate cooperatively define a channel structure 282. The supporting member 28 further comprises two ear-shaped members 283 extending from the bilateral sides 281 of the U-shaped metallic plate. In order to fix the supporting member 28 on the partition plate 201, for example, screws 284 are penetrated through perforations (not shown) of the ear-shaped members 283 and then screwed into the screw holes (not shown) of the partition plate 201. In addition, each of the bilateral sides 281 of the U-shaped metallic plate has a protrusion part 285 such as a salient in the middle and upper edge thereof.

Figure 5:
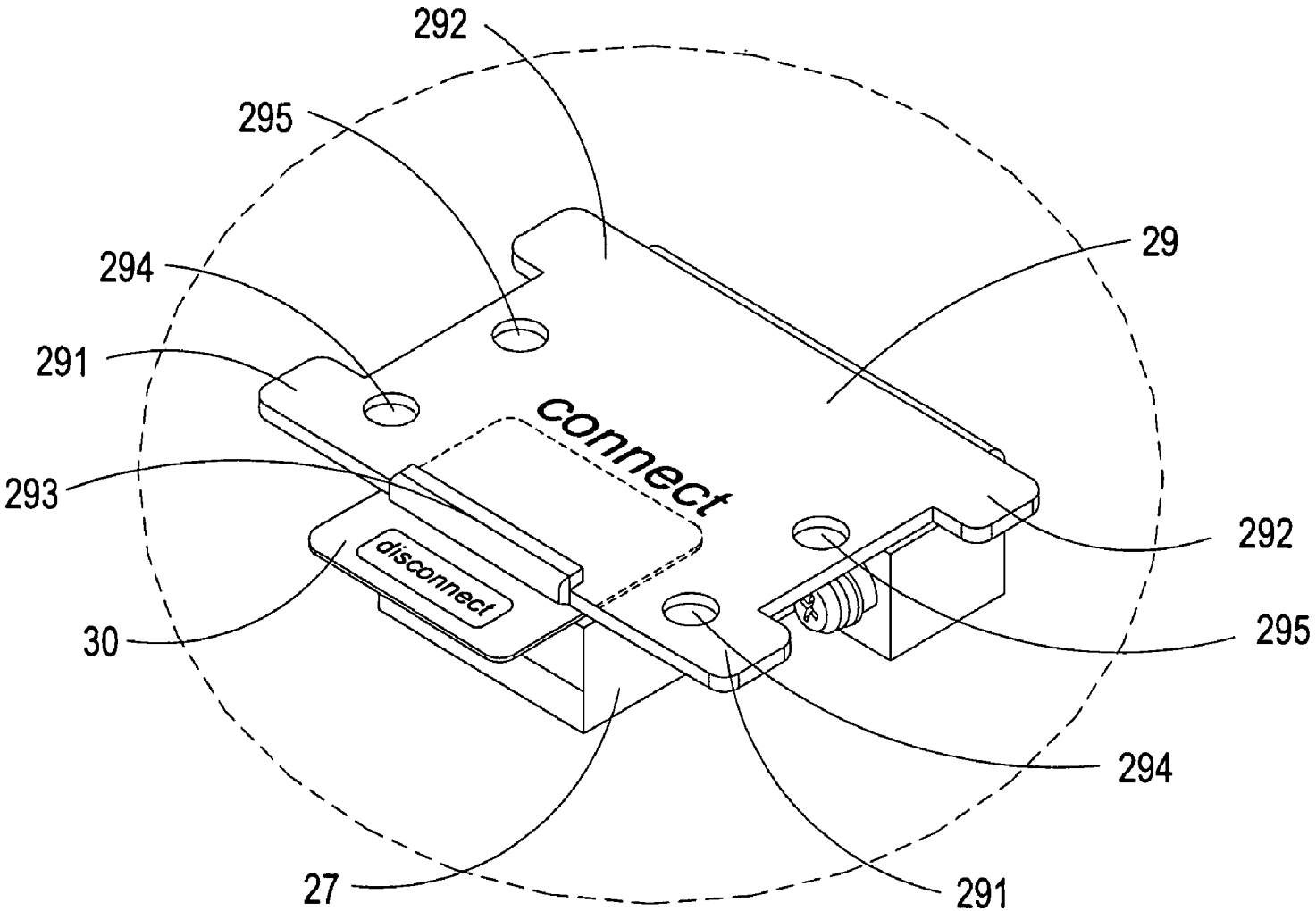
FIG. 5 is an enlarged partial view of the area C of the UPS apparatus shown in FIG. 2.

Please refer to FIG. 5, which is an enlarged partial view of the area C of the UPS apparatus 2 shown in FIG. 2. The adjustable connection mechanism of the present invention further comprises a second connector 27 and a carrier plate 29. The rear end of the second connector 27 is coupled with the control module 23 and the power supply module 21 via a power cord (not shown). The front end of the second connector 27 has conducting terminals (not shown) to be coupled with corresponding conducting terminals of the first connector 26 of the battery module 22. The second connector 27 is fixed on the carrier plate 29, which is substantially a metallic plate. Each lateral edge of the carrier plate 29 includes a first retaining part 291 and a second retaining part 292, which are preferably salients. Optionally, an indication plate 30 is arranged between the second connector 27 and the carrier plate 29 and extended from the periphery of the carrier plate 29. The carrier plate 29 further includes a force-exerting portion 293 disposed at the surface of the carrier plate 29 opposite to the second connector 27. An example of the force-exerting portion 293 includes but is not limited to a raised block protruded from the carrier plate 29 or a recess structure indented within the surface of the carrier plate 29. Furthermore, each lateral edge of the carrier plate 29 includes a first fixing hole 294 and a second fixing hole 295.

Figure 6:
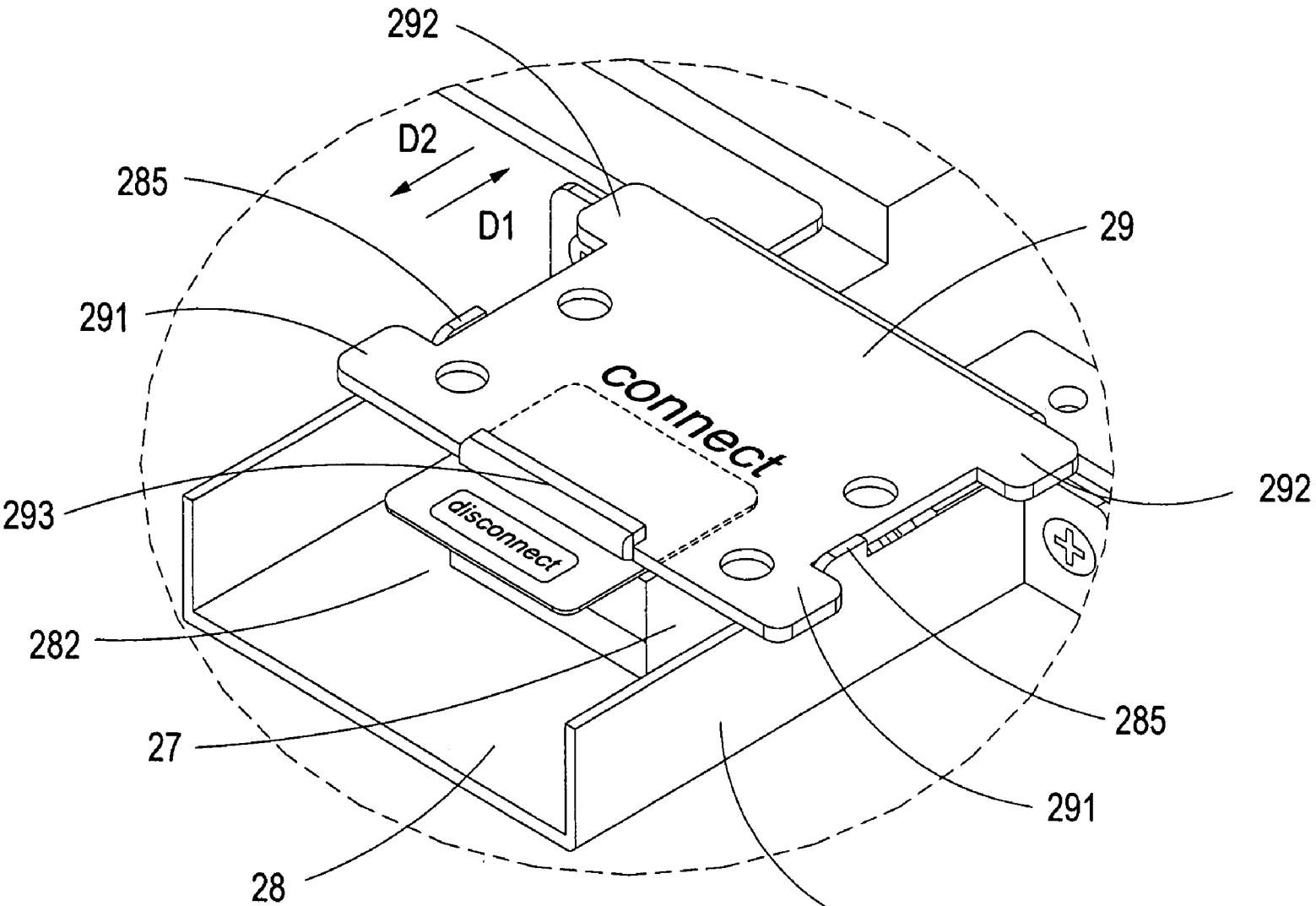
FIG. 6 illustrates the relative locations between the carrier plate, the second connector and the supporting member.

Referring to FIG. 6, the relative locations between the carrier plate 29, the second connector 27 and the supporting member 28 is shown. The second connector 27 is supported by the carrier plate 29, which is supported on the supporting member 28. The first retaining parts 291 and the second retaining parts 292 of the carrier plate 29 are supported on the upper edges of the bilateral sides 281 of the supporting member 28. The protrusion parts 285 of the bilateral sides 281 of the supporting member 28 are disposed between the first retaining part 291 and the second retaining part 292. The second connector 27 is movable along the channel structure 282 of the supporting member 28 between a first position and a second position. For example, when an external force is applied on the force-exerting portion 293 of the carrier plate 29 in the direction D1 such that the first retaining part 291 of the carrier plate 29 is sustained against the protrusion parts 285 of the supporting member 28, the carrier plate 29 along with the second connector 27 is moved to the first position. Whereas, when another external force is applied on the force-exerting portion 293 of the carrier plate 29 in the direction D2 such that the second retaining part 292 of the carrier plate 29 is sustained against the protrusion parts 285 of the supporting member 28, the carrier plate 29 along with the second connector 27 is moved to the second position.

Figure 7A:
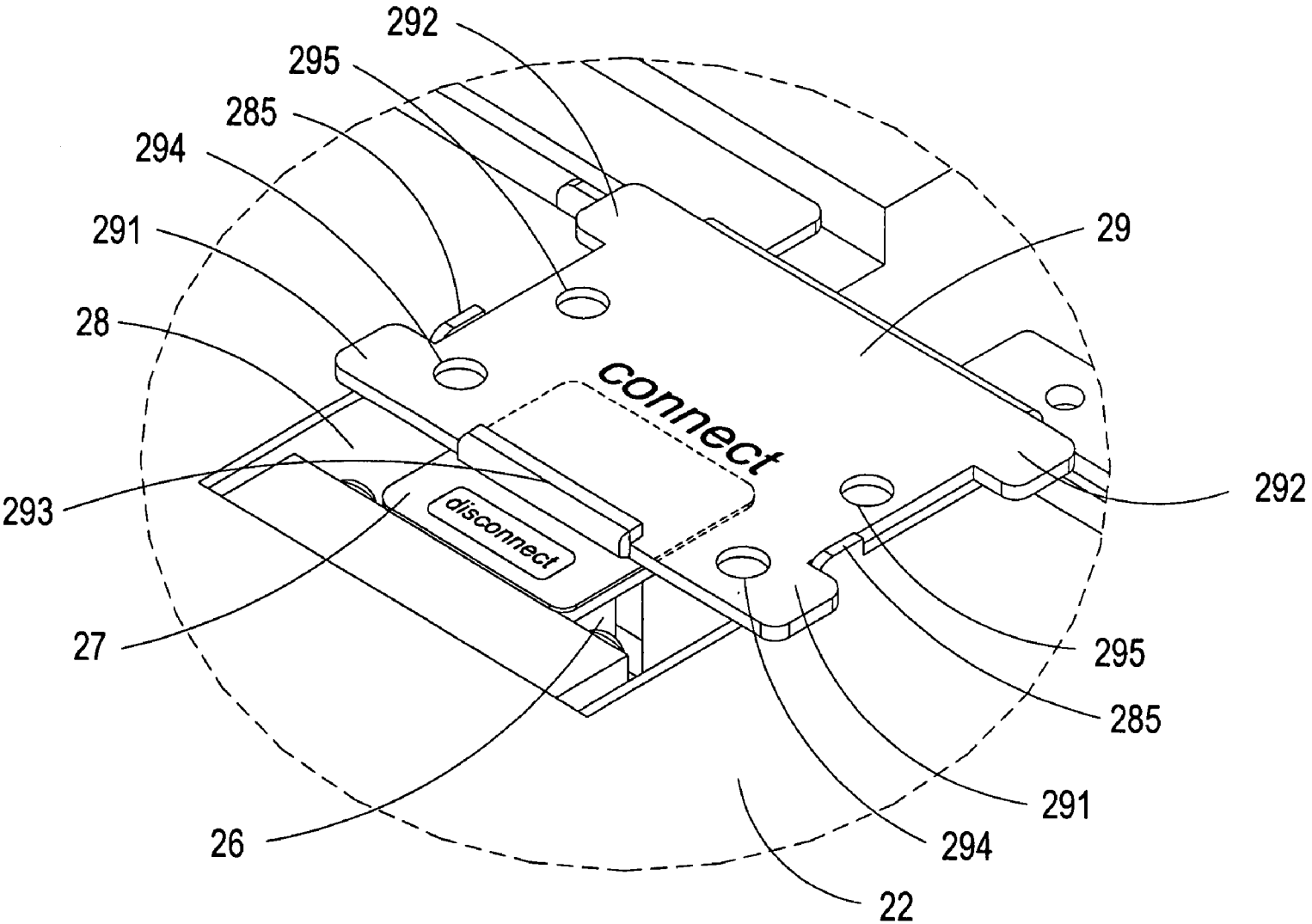
FIGS. 7(*a*) and 7(*b*) illustrates the relative locations between the carrier plate, the second connector, the supporting member and the battery module.
Figure 7B:
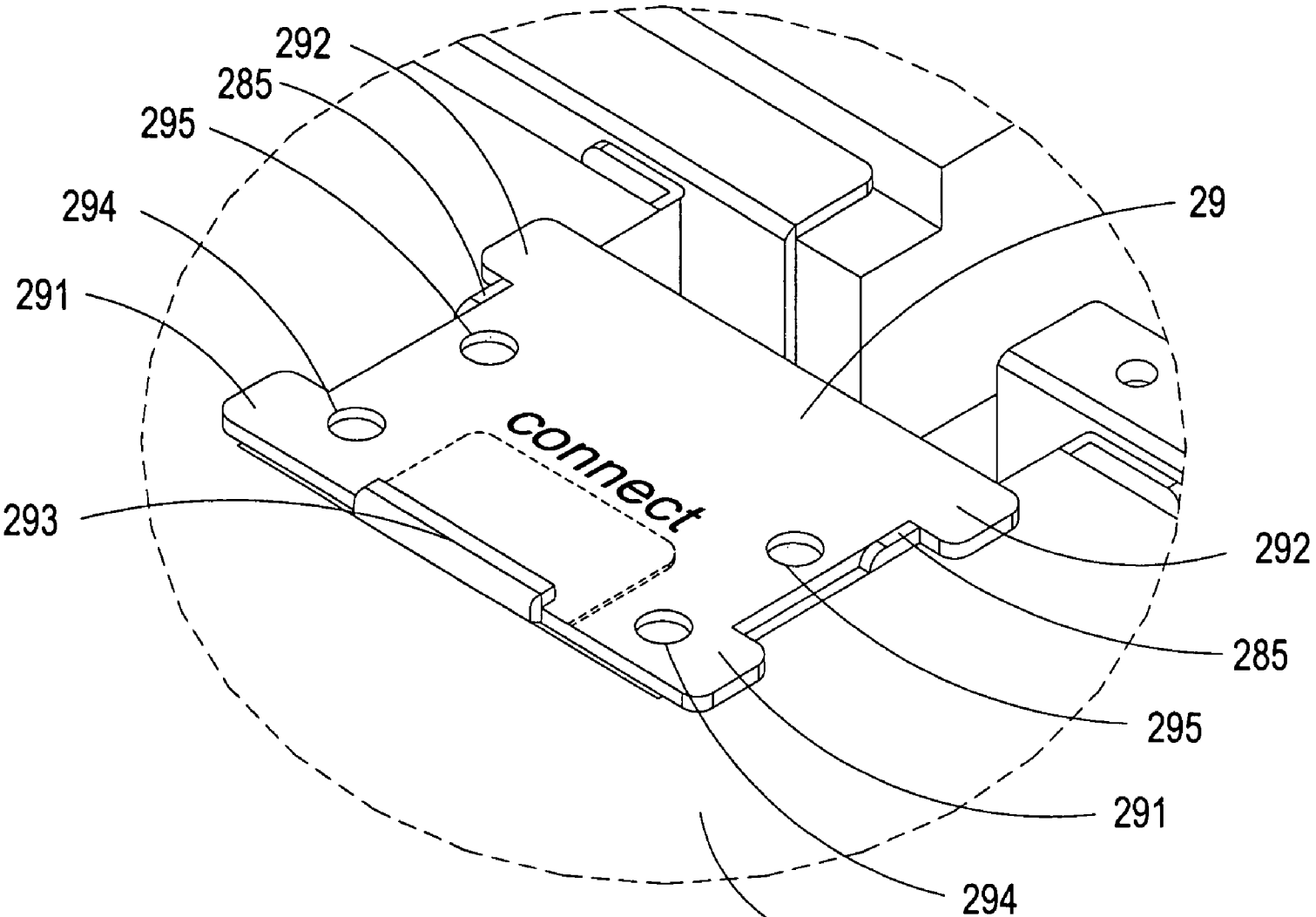

Referring to FIGS. 7(*a*) and 7(*b*), the relative locations between the carrier plate 29, the second connector 27, the supporting member 28 and the battery module 22 is shown. As shown in FIGS. 2, 6 and 7(*a*), when the second connector 27 is moved to the first position, the connector 26 is disconnected with the second connector 27. Meanwhile, the battery module 22 is disconnected with the control module 23 and the power supply module 21. On the contrary, if the second connector 27 is moved to the second position as shown in FIG. 7(*b*), the conducting terminals of the connector 26 and the second connector 27 are electrically connected with each other. Meanwhile, the battery module 22 is connected with the control module 23 and the power supply module 21.

Please refer to FIG. 2 again. The first cover plate 24 has an opening 241 corresponding to the force-exerting portion 293 of the carrier plate 29. After the first cover plate 24 is coupled with the case 20, the force-exerting portion 293 is penetrated through the opening 241 for facilitating a user to exert an external force thereon. Depending on the movable length of the carrier plate 29, the dimension of the opening 241 can be varied. For example, when the carrier plate 29 is moved to the second position, the force-exerting portion 293 is also sustained against the periphery of the opening 241. Meanwhile, the text or graph "DISCONNECT" indicated on the indication plate 30 is sheltered by the first cover plate 24 but the text or graph "CONNECT" indicated on the carrier plate 29 is viewed via the opening 241. Under this circumstance, the user may realize that the battery module 22 is connected with the control module 23 and the power supply module 21.

On the other hand, when the carrier plate 29 along with the second connector 27 is moved to the second position, the text or graph "CONNECT" indicated on the carrier plate 29 is sheltered by the first cover plate 24 but the text or graph "DISCONNECT" indicated on the indication plate 30 is viewed via the opening 241. Under this circumstance, the user may realize that the battery module 22 is disconnected with the control module 23 and the power supply module 21.

Figure 8B:
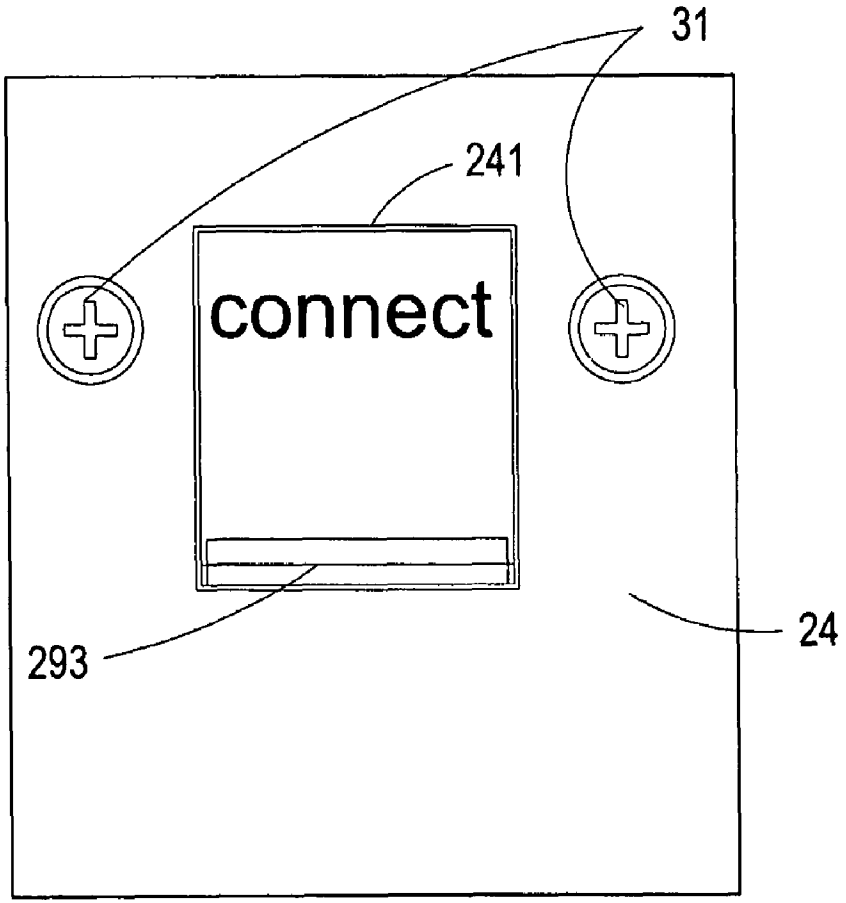
FIGS. 8(*a*) and 8(*b*) are top views of the adjustable connection mechanism operated in a disconnection mode and a connection mode, respectively.
Figure 8A:
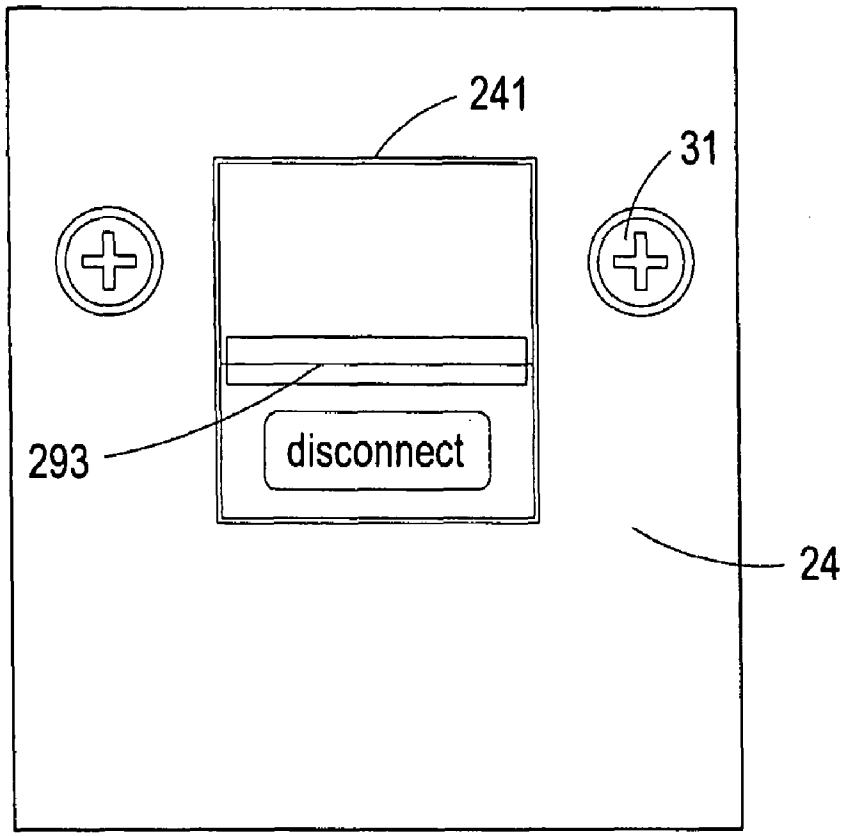

Please refer to FIG. 2 again. The first cover plate 24 further has two perforations 242 besides the opening 241 and corresponding to the first fixing holes 294 and the second fixing holes 295 of carrier plate 29. If the carrier plate 29 is moved to the first position, the first fixing holes 294 is aligned with the perforations 242. By allowing crews 31 to be penetrated through the perforations 242 and screwed into the first fixing holes 294, the carrier plate 29 is fixed at the first position, as can be seen in the top view of FIG. 8(*a*). Similarly, if the carrier plate 29 is moved to the second position, the second fixing holes 295 will be aligned with the perforations 242. By allowing crews 31 to be penetrated through the perforations 242 and screwed into the second fixing holes 295, the carrier plate 29 is fixed at the second position, as can be seen in the top view of FIG. 8(*b*).

In the above embodiments, the battery module 22 is fixedly secured within the case 21. Alternatively, the battery module 22 is hot-swapped. By using the adjustable connection mechanism of the present invention, the first connector 26 of the battery module 22 is adjusted to either connect or disconnect with the second connector 27 of other module upon switching the force-exerting portion 293, so that the process of operating the adjustable connection mechanism may save labor.

The adjustable connection mechanism provided by the present invention, when comparing with other previous conventional technologies, has many advantages. For example, the first connector of the battery module is selectively connected or disconnected with the second connector of other module without dismantling the front panel or hot swapping the battery module. In addition, the text or graph indicated on the carrier plate is viewed via the opening of the cover plate such that the user will realize the connecting status of the UPS apparatus. When compared with the conventional mechanism of using electronic switch devices, the adjustable connection mechanism of the present invention is more cost-effective due to the simplified arrangement.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An adjustable connection mechanism of an uninterruptible power supply apparatus, said uninterruptible power supply apparatus including a case accommodating therein a power supply module, a battery module and a control module, said adjustable connection mechanism comprising:

a first connector arranged on said battery module and electrically connected to said battery module;

a second connector electrically connected to said power supply module and said control module;

a supporting member disposed within said case for supporting said second connector; and a carrier plate coupled with said second connector, and selectively movable to a first position to have said second connector disconnect with said first connector or movable to a second position to have said second connector connect with said first connector.

2. The adjustable connection mechanism according to claim 1 wherein said power supply module, said battery module and said control module are accommodated within respective compartments, which are partitioned by a first partition plate and a second partition plate, wherein said first partition plate is perpendicular to said second partition plate.

3. The adjustable connection mechanism according to claim 2 wherein said battery module has an indentation structure at a top edge thereof, said first connector is protruded from an inner wall of said indentation structure, and said first connector is distant from the bilateral walls of the indentation structure and the bottom surface of said indentation structure by a first gap and a second gap, respectively.

4. The adjustable connection mechanism according to claim 3 wherein said first partition plate has a notch, wherein said supporting member is disposed in the vicinity of said notch and perpendicular to said first partition plate, and faces to said indentation structure of said battery module.

5. The adjustable connection mechanism according to claim 4 wherein said supporting member is substantially a U-shaped metallic plate, the bilateral sides and the bottom side of said U-shaped metallic plate cooperatively define a channel structure, and each lateral side of said U-shaped metallic plate has a protrusion part in the middle and upper edge thereof.

6. The adjustable connection mechanism according to claim 5 wherein each lateral edge of said carrier plate further comprises:

a first retaining part and a second retaining part, which are salients;

a first fixing hole and a second fixing hole; and a force-exerting portion disposed at the surface of said carrier plate opposite to said second connector, wherein said force-exerting portion includes a raised block or a recess structure.

7. The adjustable connection mechanism according to claim 6 wherein said uninterruptible power supply apparatus further comprises a first cover plate to be coupled with the housing, and said first cover plate has an opening corresponding to said force-exerting portion of the carrier plate and two perforations besides said opening, wherein said force-exerting portion is penetrated through said opening for facilitating a user to exert an external force thereon.

8. The adjustable connection mechanism according to claim 7 wherein said first retaining parts and said second retaining parts of said carrier plate are supported on the upper edges of the bilateral sides of said supporting member, each protrusion part of said supporting member is disposed between said first retaining part and said second retaining part, and said second connector is movable along said channel structure of said supporting member between said first position and said second position.

9. The adjustable connection mechanism according to claim 8 wherein said second connector is moved to said first position by applying said external force on said force-exerting portion of said carrier plate such that said first retaining part of said carrier plate is sustained against said protrusion part of said supporting member, and screws are penetrated through said perforations and screwed into said first fixing holes, thereby fixing said carrier plate at said first position.

10. The adjustable connection mechanism according to claim 8 wherein said second connector is moved to said second position by applying said external force on said force-exerting portion of said carrier plate such that said second retaining part of said carrier plate is sustained against said protrusion part of said supporting member, and screws are penetrated through said perforations and screwed into said second fixing holes, thereby fixing said carrier plate at said second position.

11. The adjustable connection mechanism according to claim 8 further comprising an indication plate arranged between said second connector and said carrier plate and extended from the periphery of said carrier plate, thereby facilitating a user to view the connection status of said uninterruptible power supply apparatus.

* * * * *